US005941527A

United States Patent [19]

Selton

[11] Patent Number: 5,941,527

[45] Date of Patent: Aug. 24, 1999

[54] THREE DIMENSIONAL STRATEGY GAME

[76] Inventor: Daniel E. Selton, 5350 Powers Ferry Rd., Atlanta, Ga. 30327

[21] Appl. No.: 09/020,392

[22] Filed: Feb. 9, 1998

[51] Int. Cl.[6] ..... A63F 9/00

[52] U.S. Cl. ..... 273/276; 273/160

[58] Field of Search ..... 273/153 R, 160, 273/156, 276, 241, 290, 449, 450; 446/126

[56] References Cited

U.S. PATENT DOCUMENTS

| | | | |
|---|---|---|---|
| 1,284,513 | 11/1918 | West | 273/276 |
| 1,591,554 | 7/1926 | Buion | 273/276 |
| 3,452,989 | 7/1969 | Jernstrom | 273/276 |
| 3,545,123 | 12/1970 | Muller | 446/126 |
| 3,955,814 | 5/1976 | Shallenberger | 273/449 |
| 5,301,953 | 4/1994 | Levin | 273/276 |
| 5,316,307 | 5/1994 | Kersh | 273/241 |
| 5,613,681 | 3/1997 | Allen | 273/271 |
| 5,803,782 | 9/1998 | Selton | 446/126 |

FOREIGN PATENT DOCUMENTS

| | | | |
|---|---|---|---|
| 619629 | 10/1980 | Switzerland | 273/276 |
| 1383052 | 1/1973 | United Kingdom | 273/276 |
| 3017767 | 9/1993 | WIPO | 273/276 |

*Primary Examiner*—Steven Wong

*Attorney, Agent, or Firm*—Troutman Sanders LLP; Gerald R. Boss, Esq.

[57] ABSTRACT

A three dimensional strategy game and method for its play are provided, wherein multiple game pieces are assembled into geometrical configurations without the limitations imposed by a pre-existing support structure and wherein the interior of the three dimensional geometrical configuration is easily viewable. The three dimensional strategy game includes an orientation game piece and two or more sets of game pieces which may be matingly interconnected to construct geometric configurations. In addition to the game pieces, a directional indicator may also provided for indicating the direction from which each game piece must also be added to the growing geometric configuration. Each game piece has a plurality of sides extending outward from a central area with each side carrying an interconnecting member for matingly receiving a portion of an interconnecting member for connection to other game pieces.

6 Claims, 2 Drawing Sheets

THREE DIMENSIONAL STRATEGY GAME

BACKGROUND OF THE INVENTION

1. Technical Field

This invention relates generally to a strategy game and in particular to a three dimensional strategy game utilizing an assembly of game pieces to create specific geometric configurations, whereby the positioning of the game pieces alternates between a plurality of players and is dictated by a game piece directional indicator.

2. Description of the Prior Art

Three dimensional strategy games are known. For example, U.S. Pat. No. 5,316,307 discloses a three dimensional strategy game including four discs arranged one above another in three dimensions. Each disc contains locations wherein a game piece may be placed. The object of this game is for a player to arrange his game pieces into a particular geometric pattern such as a line, circle or spiral. The positioning of the game pieces is fully under the discretion of the player. The winner of a game is the player who produces a winning geometric pattern or the player who discovers a sequence unknowingly produced by another player.

Another example of a three dimensional strategy game can be found in U.S. Pat. No. 5,613,681 which discloses a three dimensional variant of Tic-Tac-Toe. This game includes a cubic support lattice defining a series of cells into which game pieces may be placed. As in Tic-Tac-Toe, the object of this game is to form a specific geometric pattern such as three in a row or nine in a single plane. An important feature of this invention is that one game piece may be forced against another to move game pieces within the support lattice from one cell to another.

Two dimensional strategy games involving the assembly of geometric components and incorporating a random chance factor are also known. For example, U.S. Pat. No. 5,301,953 discloses a game wherein each player must add geometric pieces to fill the surface of his playing area. In this game, a die is rolled to determine the shape of the next piece which should be added or removed from the playing area of the opposing player.

However, while each of these games are sufficient for their intended purpose, there is a need for a three dimensional strategy game incorporating the construction of geometric configurations which is manipulated by an element of chance.

It is therefore an object of the present invention to provide a new and improved three dimensional game of strategy, wherein multiple game pieces are assembled into geometrical configurations without the limitations imposed by a pre-existing support structure.

It is another object of the present invention to provide a new and improved three dimensional game of strategy, wherein multiple game pieces are assembled into geometrical configurations wherein the positioning of alternating game pieces is dictated by an orientation piece and a directional indicator.

It is also an object of the present invention to provide a new and improved game piece for use in playing the aforementioned game.

SUMMARY OF THE INVENTION

The above objectives are accomplished according to the present invention by providing a three dimensional strategy game which includes an orientation game piece and two or more sets of game pieces which may be matingly interconnected to construct geometric configurations. In addition to the game pieces, a directional indicator may also be provided for indicating the direction from which each game piece must be added to the growing geometric configuration with respect to the orientation of the orientation piece. Each game piece has a plurality of sides for matingly receiving a portion of an interconnecting member for connection to other game pieces.

The aforementioned and other aspects, objects and advantages of the present invention are described in the detailed description and attached illustrations which follow.

BRIEF DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown, and wherein.

DETAILED DESCRIPTION OF PREFERRED EMBODIMENT

Figure 1:
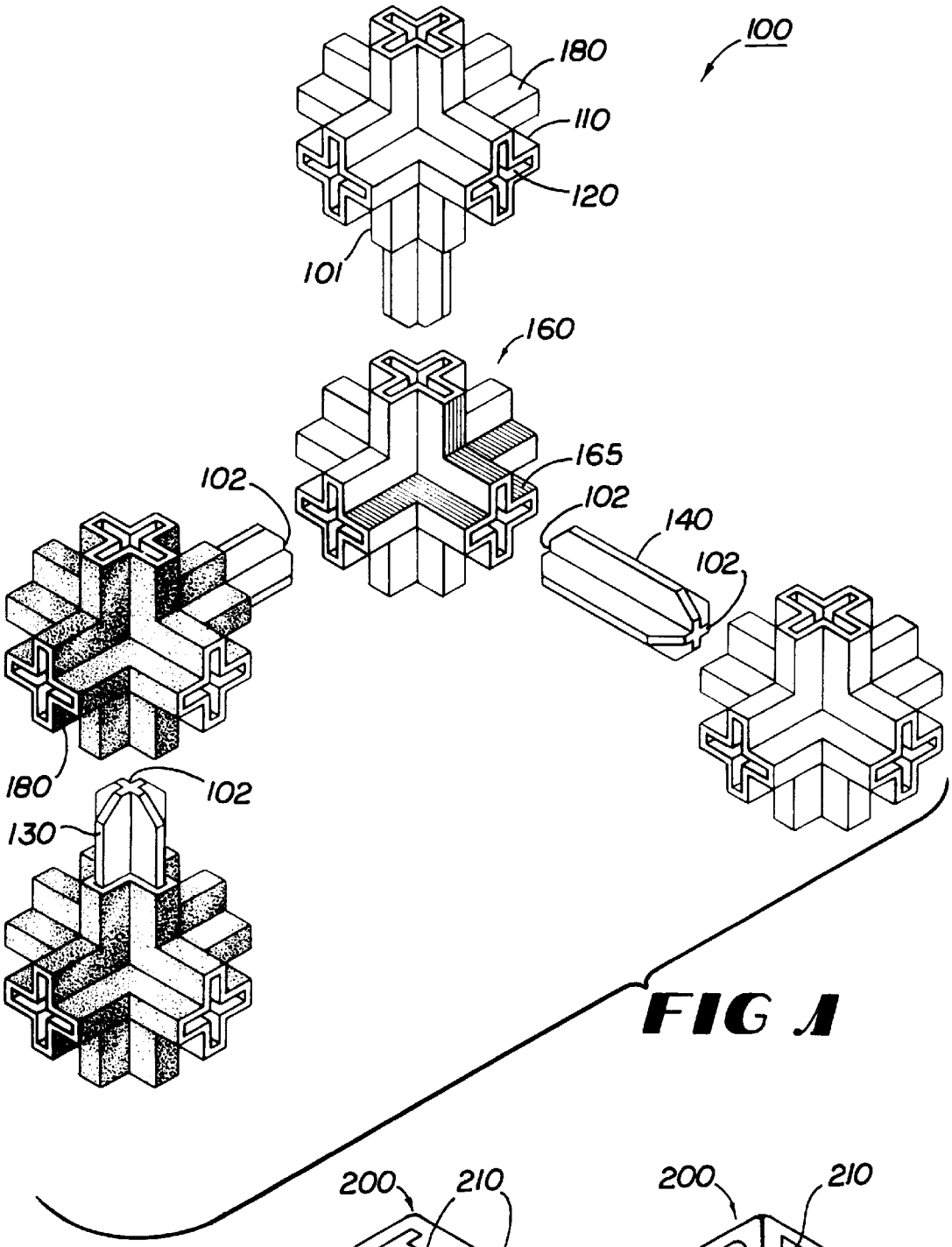
FIG. 1 is a perspective view of several game pieces and an orientation piece according to the present invention.
Figure 3:
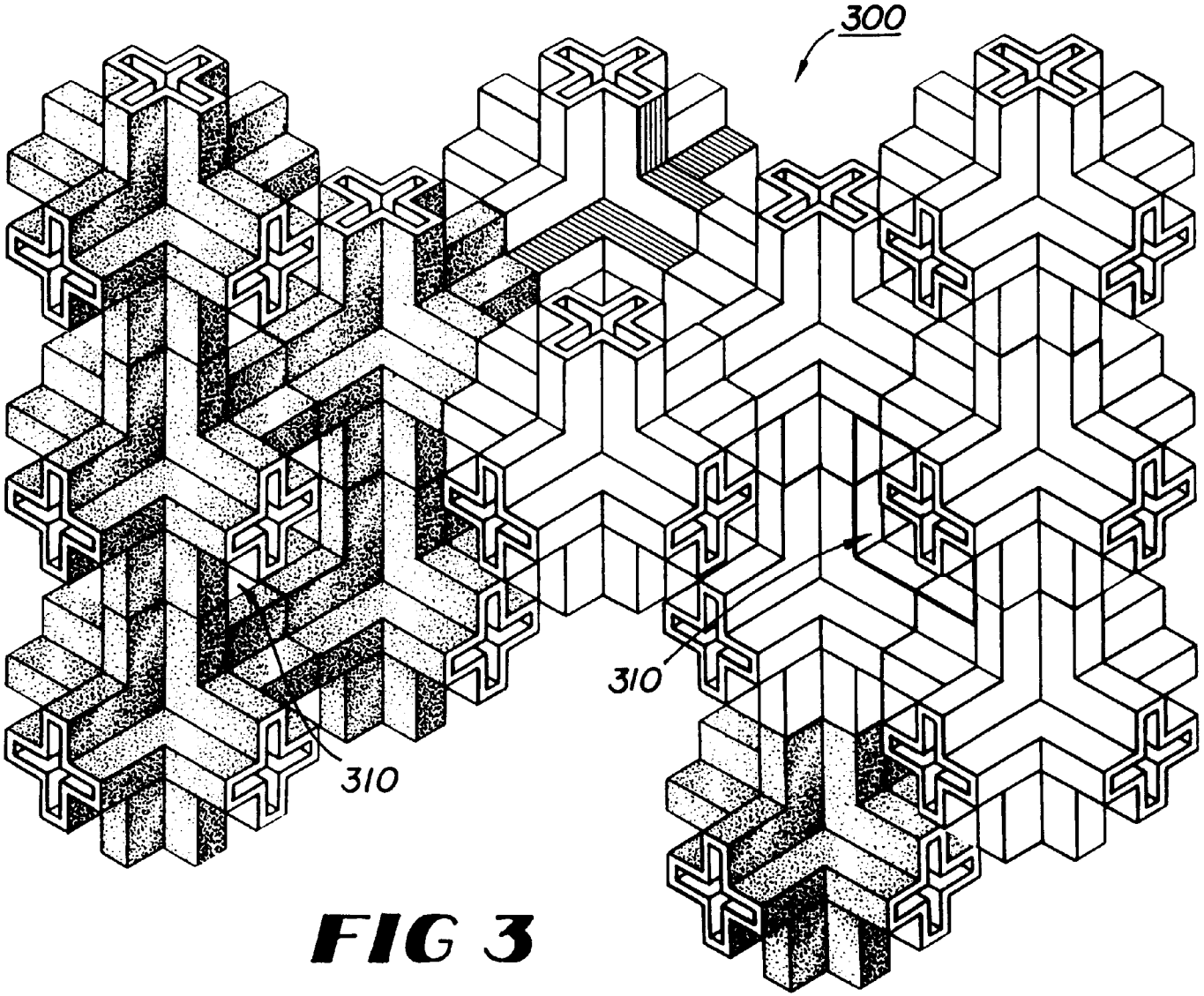
FIG. 3 is a perspective view of an assembly of game pieces constituting a three dimensional geometric configuration according to the present invention.

Referring now to FIGS. 1 and 3, in a preferred embodiment the three dimensional strategy game includes a plurality of game pieces 100. Each game piece 100 includes six sides which extend in three dimensional space from a central area along perpendicular axes. In the preferred embodiment, each side includes either a male or female connector extending therefrom. The female connector 101 includes sleeve 110 extending from the central area and defining an axial chamber 120. The male connector includes a male connecting portion 102 for matingly connecting with a female connector 101.

In the preferred embodiment, most game pieces 100 include only female connectors 101 including sleeve 110 and axial chamber 120. However, a subset of game pieces 100 may also comprise an integral interconnecting member 130 having a male connecting portion 102 in place of one or more of the extending sleeves 110 to facilitate direct connection to the axial chamber 120 of another game piece 100. Alternatively, separate connector pieces 140 having male connecting portions 102 may be used to connect two respective game pieces 100 by being received within the respective axial chambers 120 of each game piece. In the preferred embodiment, a set of game pieces include five female connectors and one male connector.

Axial chamber 120 serves as a complementary receiver adapted to matingly receive a complementary male interconnecting member 130. In the preferred embodiment, the axial chamber 120 has a cruciform cross sectional shape. It should, however, be obvious to one skilled in the art that the axial chamber 120 may have any cross sectional shape which is adapted to receive a complementary male interconnecting member 130 of a separate connecting member 140 or another game piece 100. Examples of alternative cross sectional shapes include, but are not limited to a square, a rectangle, a triangle, a polygon, a circle, and an ellipse.

In the preferred embodiment, the game pieces 100 include indicia 180 for identifying the game pieces 100 as members of a particular set of game pieces 100 associated with a particular player. The distinguishing indicia 180 may be color, the presence of a pattern on the surface of the game pieces 100, or may be an inherent geometric feature of the game piece 100, such as a spherical or cube located in the central region of the game piece 100.

The game also includes an orientation piece 160 which is uniquely marked to identify it as the starting point for construction of the geometric configuration 300. Furthermore, the markings also define an initial orientation of the geometric configuration 300 and a set of axial directions based relative to the orientation piece 160. In the preferred embodiment, the orientation piece 160 has a structure similar to a game piece 100, and is distinctively marked with a colored portion 165 or design to establish the orientation of the geometric configuration 300 relative to the orientation piece 160.

Figure 2A:
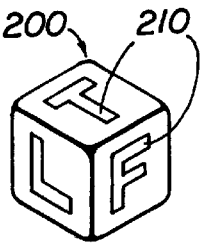
FIGS. 2A and 2B are perspective views of a pair of directional indicators in accordance with the present invention.
Figure 2B:
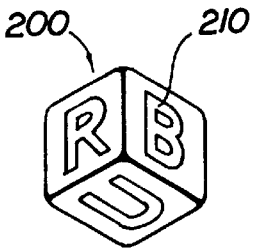

Referring now to FIGS. 2A and 2B, a directional indicator 200 determines the direction from which the next game piece 100 must be added to the growing geometric configuration 300. In the preferred embodiment, the directional indicator 200 includes at least one die for randomly selecting a direction. The die is chosen because it has six sides corresponding with the possible connections which may be made with the game piece 100. Alternatively, a directional indicator 200 having a differing corresponding number of sides may be utilized. The die is marked with a directional marking 210 on each side, and may be rolled by a player at the beginning of his turn in order to determine the direction of addition for the game piece 100. One skilled in the art will recognize that a variety of other directional indicators 200 would suffice to designate a direction of addition for the game piece 100, including use of a computerized random number generator, a spinnable wheel or a deck of cards. A variant of the game may also be played based solely on the strategic abilities of the players by omitting the use of a directional indicator 200.

In the preferred embodiment, game play progresses as follows. The players decide who is to have the first turn. The first player then operates the directional indicator 200 to determine which direction the first of the game pieces 100 must be positioned with respect to the orientation piece 160. For example, if the player rolls a R on the die, he would add the game piece 100 to the side of the orientation piece 160 designated as the "right" side. Play then progresses to the next player. Each player in turn rolls the direction indicating die and then adds a game piece 100 to the growing geometric configuration 300 from the indicated side. As play progresses and the geometric configuration 300 becomes more complex, each player will be presented with an increased number of potential sites for game piece 100 addition.

It is important to note that the axial sleeves 110 and connecting members 130 extend from game pieces 100 to create a central aperture 310 when interconnected game pieces are assembled into a geometric configuration 300. The central aperture 310 allows the players to easily view the interior of the geometric configuration 300 to determine a strategy when adding game pieces 100 and when scoring.

Game play continues until one player has constructed a desired geometric configuration 300, such as a square, "T" or "L" shaped assembly of the player's particular game pieces 100. Alternatively, the game may continue until all game pieces 100 have been added and a winner calculated by scoring points for each desirable geometric configuration constructed by a player.

In one game variant, the goal of the three dimensional strategy game is to be the first to create four, four-game piece 100 squares with the player's respective color game pieces 100. The squares may be horizontal or vertical, and may be independent or share common game pieces 100 of the same color in the preferred embodiment.

Players each choose one set of colored game pieces 100. Players then determine number of squares to be created as the goal (one to four squares) and roll a doubling cube to see who goes first (highest roll goes first). Player One rolls a die to determine where to connect his/her game piece 100 to the orientation piece 160. Game pieces 100 are connected to the geometric configuration 300 from the direction indicated on the die roll where the direction of game piece 100 placement when facing the front of the orientation piece 160 is as follows:

Die Roll=F=approach and connect from the Front

Die Roll=B=approach and connect from the Back

Die Roll=L=approach and connect from the Left

Die Roll=R=approach and connect from the Right

Die Roll=T=approach and connect from the Top

Die Roll=U=approach and connect from Under

All players must approach and connect from the direction indicated. Player One's turn is over when Player One has connected one game piece 100 and he/she hands the geometric configuration 300 to the opposing player. (Time limits may be set). Player Two then manipulates the directional indicator to determine where to connect his/her game piece 100 to the geometric configuration 300. Players continue alternating turns, connecting game pieces 100 to create their own color squares or to block the opponent's squares, until one player forms his/her fourth square (or number of squares set by the goal). Squares can be either independent squares or squares sharing common game pieces 100 of the same color in the preferred embodiment. The orientation piece 160 may not be used as part of any Square. If all game pieces 100 are used, players continue alternating turns by removing one of their outside game pieces 100 at a time and replaying it, until the goal is reached or a draw is declared.

What have been described above are preferred embodiments of the present invention. It is, of course, not possible to describe every conceivable combination of methodologies for purposes of describing the present invention. However, one of ordinary skill in the art will recognize that many further combinations, permutations and modifications of the present invention are possible. Therefore, all such possible combinations, permutations and modifications are to be included within the scope of the claimed invention, as defined by the claims below.

What is claimed is:

1. A three dimensional strategy game comprising:

an orientation piece for establishing an initial point of orientation for a geometric configuration, said orientation piece having a plurality of sides, each respective side defining a connector;

a set of first game pieces, said first game pieces having a plurality of sides, each respective side defining a connector;

a set of second game pieces, said second game pieces having a plurality of sides, each respective side defining a connector, wherein a connector of a representative game piece of said first or second sets of game pieces may be interconnected with a connecting member of another representative of either said first or second sets of game pieces or said orientation piece for constructing a geometrical configuration; and a directional indicator for indicating the direction from which a game piece must be added to the geometric configuration.

2. The game of claim 1, wherein said first and second set of game pieces may be interconnected to form a geometric configuration having a central aperture thereby allowing the player to view the interior of the geometric configuration.

3. The game of claim 1, wherein said directional indicator randomly identifies at least one direction from which the next game piece must also be positioned on the geometric configuration.

4. The game of claim 1, further comprising a separate connecting member for connecting two of said respective game pieces.

5. A method for a three dimensional strategy game, said method comprising the steps of:

establishing an initial point and orientation of a three dimensional geometric configuration with an orientation piece;

manipulating a directional indicator to indicate the directional placement of a first game piece;

positioning a first game piece on the geometric configuration as randomly indicated by said directional indicator, said game piece representing a member of a first set of game pieces for use by a first player;

manipulating said directional indicator to indicate the directional placement of a second game piece;

positioning a second game piece on the geometric configuration as randomly indicated by said directional indicator, said game piece representing a member of a second set of game pieces for use by a second player; and repeating said manipulating of said directional indicator and positioning steps such that the first and second player alternate turns, whereby specific geometric configurations may be constructed.

6. The method of claim 5, further comprising the step of awarding a player points for successful construction of a specific geometric configuration.

* * * * *